US006765468B2

(12) United States Patent
Chen et al.

(10) Patent No.: US 6,765,468 B2
(45) Date of Patent: Jul. 20, 2004

(54) INDUCTOR MODULE INCLUDING PLURAL INDUCTOR WINDING SECTIONS CONNECTED TO A COMMON CONTACT AND WOUND ON A COMMON INDUCTOR CORE

(75) Inventors: Meng-Feng Chen, Chung-Ho (TW); Chih-Sheng Li, Chung-Ho (TW); Chien-Chi Hsu, Chung-Ho (TW)

(73) Assignee: Micro-Star Int'l Co., Ltd., Chung-Ho (TW)

( * ) Notice: Subject to any disclaimer, the term of this patent is extended or adjusted under 35 U.S.C. 154(b) by 0 days.

(21) Appl. No.: 10/337,830

(22) Filed: Jan. 8, 2003

(65) Prior Publication Data

US 2004/0017276 A1 Jan. 29, 2004

(30) Foreign Application Priority Data

Jul. 25, 2002 (TW) ..... 91211395 U

(51) Int. Cl.[7] ..... H01F 27/02
(52) U.S. Cl. ..... 336/83; 336/65; 336/192
(58) Field of Search ..... 336/83, 90, 192, 336/200, 65

(56) References Cited

U.S. PATENT DOCUMENTS 3,593,217 A * 7/1971 Weber ..... 333/175
6,087,921 A * 7/2000 Morrison ..... 336/200
6,154,112 A * 11/2000 Aoba et al. ..... 336/192
6,449,830 B1 * 9/2002 Amada et al. ..... 29/605

FOREIGN PATENT DOCUMENTS

JP 358040807 A * 3/1983 ..... 29/593
JP 401181403 A * 7/1989 ..... 336/177
JP 02001060523 A * 3/2004

* cited by examiner

*Primary Examiner*—Anh Mai
(74) *Attorney, Agent, or Firm*—Winston Hsu

(57) ABSTRACT

An inductor module includes a common inductor core and an inductor winding. The inductor winding includes a plurality of inductor winding sections, each of which has a first end and a second end, and each of which is wound on the common inductor core. The inductor winding further includes a common contact interconnecting the second ends of the inductor winding sections.

11 Claims, 3 Drawing Sheets

INDUCTOR MODULE INCLUDING PLURAL INDUCTOR WINDING SECTIONS CONNECTED TO A COMMON CONTACT AND WOUND ON A COMMON INDUCTOR CORE

CROSS-REFERENCE TO RELATED APPLICATION

This application claims priority of Taiwanese application no. 091211395, filed on Jul. 25, 2002.

BACKGROUND OF THE INVENTION

1. Field of the Invention

The invention relates to an inductor, more particularly to an inductor module that includes a plurality of inductor winding sections connected to a common contact and wound on a common inductor core.

2. Description of the Related Art

As electronic equipments become more compact, more complex and more powerful, it is generally desirable to use smaller and fewer electronic components. However, for large-scale electronic devices, conventional inductors are preferred, though bulky in size, over micro-inductors because they cost less and have larger operating currents. Inductors are the most problematic of the passive electronic components used in the manufacture of large-scale electronics assemblies because the conflicting requirements of performance, size and cost are always difficult to reconcile.

One type of a conventional inductor, particularly a toroidal inductor, has a ring-shaped core with a wire wound therearound. The two ends of the wire serve as contact points. Conventional inductors are connected in parallel in some typical applications. For example, a DC-to-DC converter on a motherboard includes two conventional inductors interconnected at one wire end to form a common contact. However, when the required number of inductors is increased, numerous drawbacks, such as inconvenience in assembling, increase in cost, bigger installation space requirement, etc., arise.

Another type of a conventional inductor has a common inductor core with separate inductor windings encased in a single package. The construction as such has the advantage of a smaller size in view of the presence of having a number of inductors with a common core as compared to the previously mentioned toroidal inductor. However, because the inductor windings are separate, an additional step is required to interconnect the same so as to form a common contact

SUMMARY OF THE INVENTION

Therefore, the object of the present invention is to provide an inductor module that is easy to assemble, that can be produced at a relatively low cost, and that includes multiple inductor winding sections connected to a common contact and wound on a common inductor core.

According to the present invention, an inductor module comprises a common inductor core and an inductor winding. The inductor winding includes a plurality of inductor winding sections, each of which has a first end and a second end, and each of which is wound on the common inductor core. The inductor winding further includes a common contact interconnecting the second ends of the inductor winding sections.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
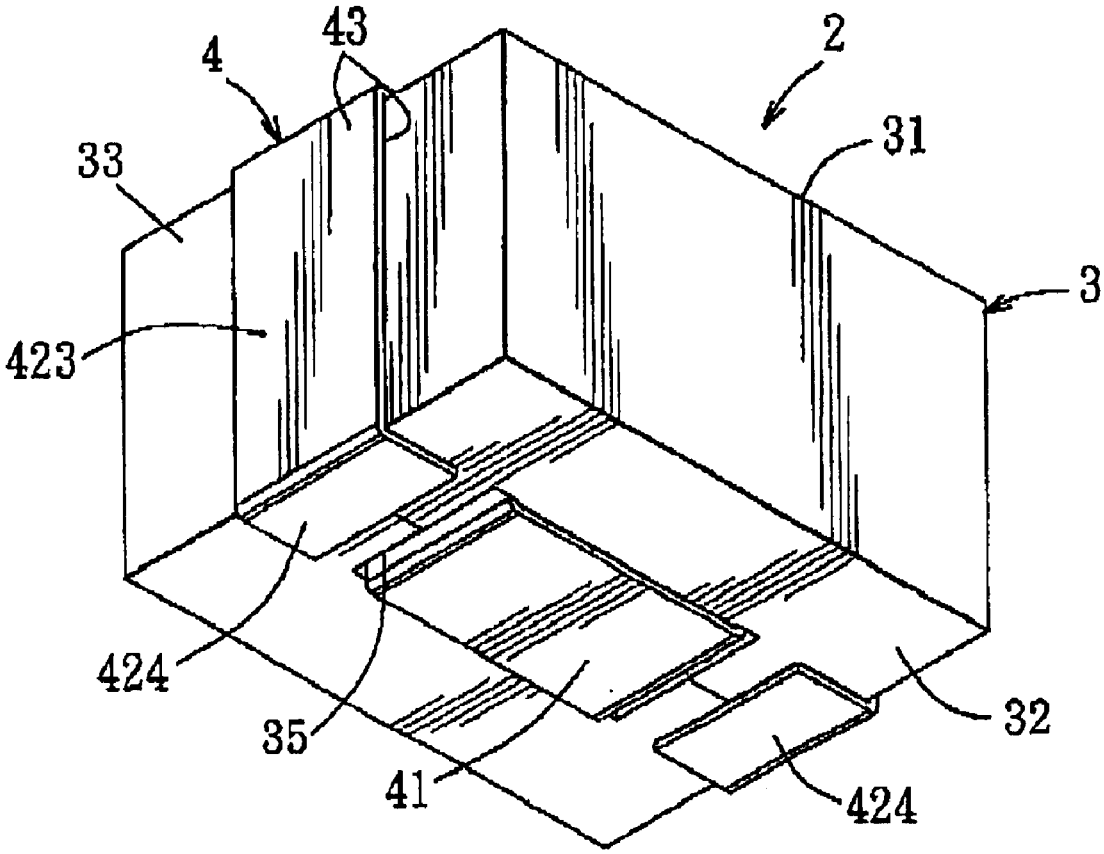
FIG. 1 is a perspective view of the first preferred embodiment of an inductor module according to the present invention.

Before the present invention is described in greater detail, it should be noted that like elements are denoted by the same reference numerals throughout the disclosure.

Figure 2:
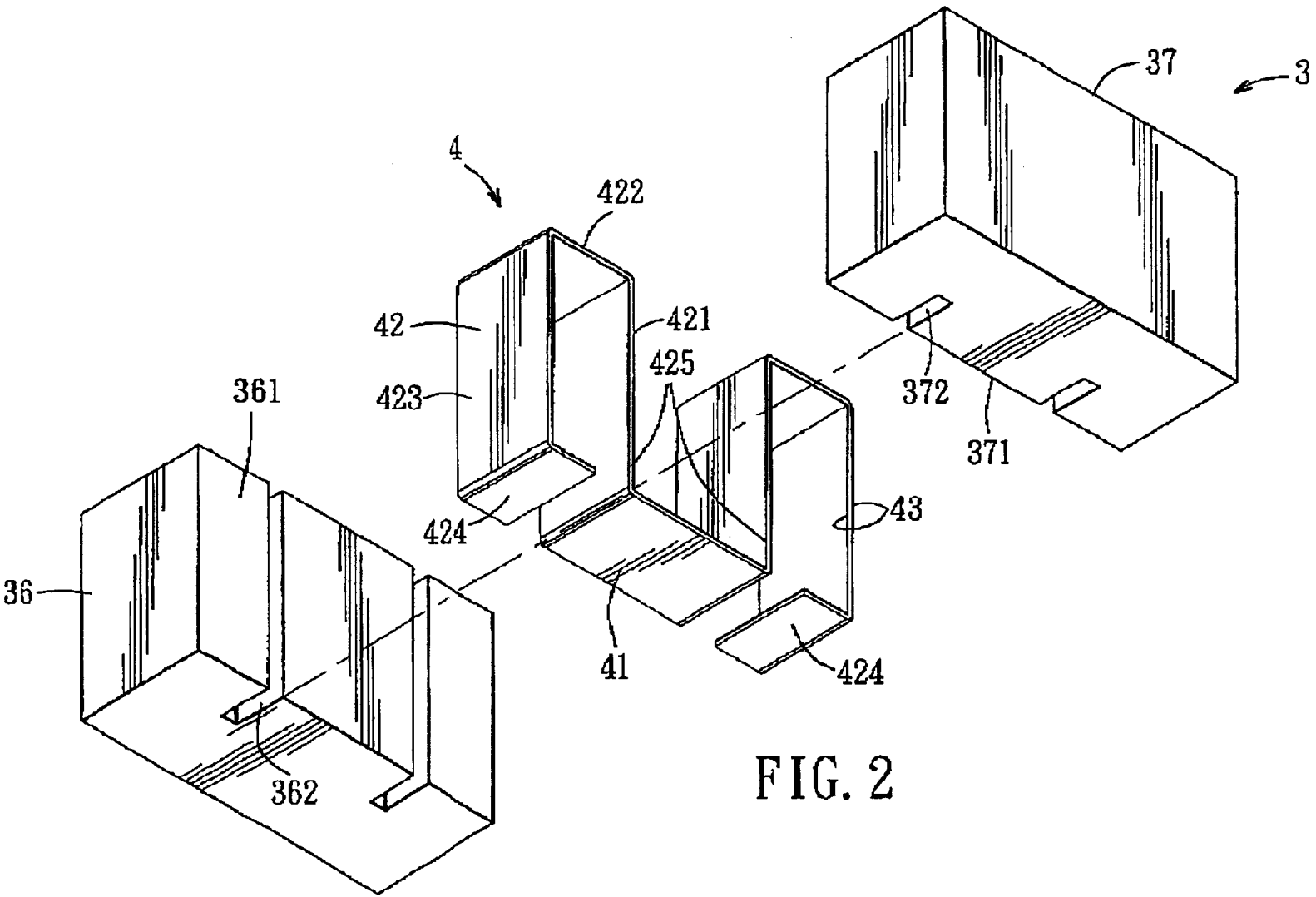
FIG. 2 is an exploded perspective view of the first preferred embodiment.
Figure 3:
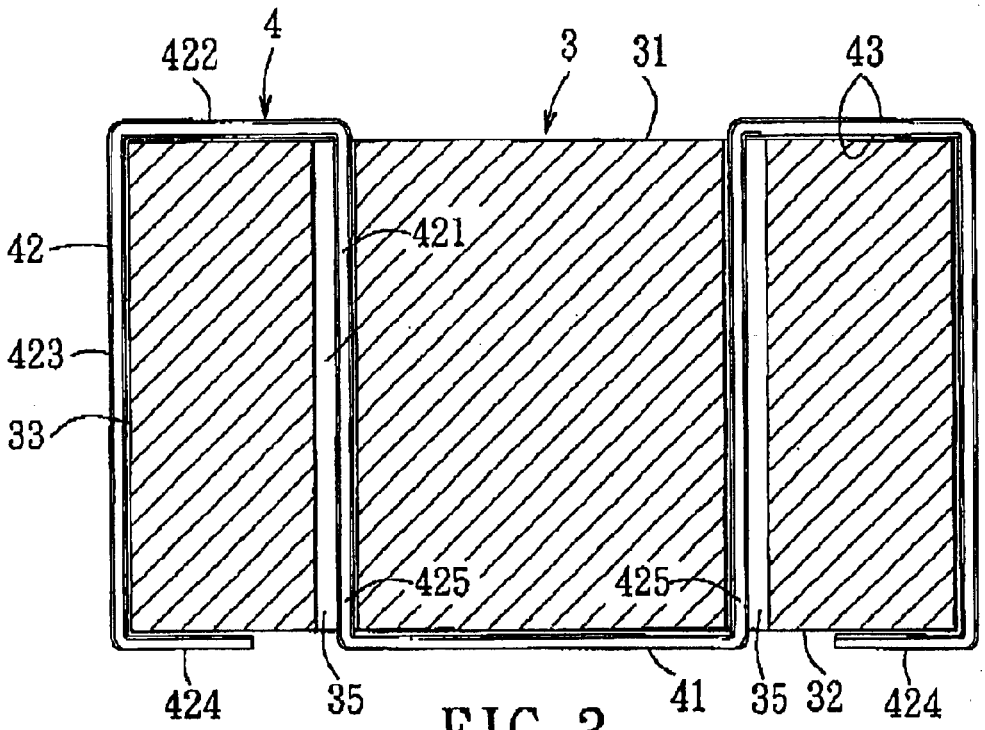
FIG. 3 is a sectional view of the first preferred embodiment.

Referring to FIGS. 1 to 3, the first preferred embodiment of an inductor module 2 according to the present invention is shown to include a common inductor core 3 and an inductor winding 4 wound on the inductor core 3. As shown in FIG. 3, the inductor core 3 is made of a magnetic material and includes a first surface 32, a second surface 31 opposite to the first surface 32, and a peripheral surface 33 extending between the first surface 32 and the second surface 31. In this embodiment, the inductor core 3 has a pair of through holes 35 that extend from the first surface 32 through the second surface 31.

Preferably as shown in FIG. 2, the inductor core 3 includes complementary rectangular core parts 36, 37 having confronting surfaces 361, 371. Each of the surfaces 361, 371 is formed with a pair of grooves 362, 372. Each of the through holes 35 is defined by a confronting pair of the grooves 362, 372 in the core parts 36, 37.

In this embodiment, the inductor winding 4 is formed integrally from a conductive foil, such as a copper foil, and includes a pair of inductor winding sections 42 interconnected by a common contact 41. Each of the inductor windings sections 42 is generally inverted-U in shape and has first and second ends 424, 425. Particularly, each of the inductor winding sections 42 has a first segment 421 formed with the second end 425 that is connected to the common contact 41, the first segment 421 extending perpendicularly from the common contact 41, a second segment 422 extending from the first segment 421, and a third segment 423 formed with the first end 424 and extending from the second segment 422. The first ends 424 of the inductor winding sections 42 serve as electrical contacts.

When assembling the inductor module 3, the first segments 421 of the inductor winding sections 42 are initially received in the grooves 362, 372 of one of the core parts 36, 37. The core parts 36, 37 are then brought toward each other such that the sides 361, 371 face each other and that the first segments 421 of the inductor winding sections 42 are simultaneously received in the grooves 362, 372 of the core parts 36, 37.

Once assembled, the common contact 41 is disposed on and lies against the first surface 32 of the inductor core 3, the first segments 421 of the inductor winding sections 42 extend respectively into the through holes 35 defined by the grooves 362, 372 in the core parts 36, 37, the second segments 422 of the inductor winding sections 42 extend along the second surface 31 of the inductor core 3, and the third segments 423 of the inductor winding sections 42 extend along the peripheral surface 33 of the inductor core 3.

As shown in FIG. 3, the first ends 424 of the inductor winding sections 42 extend along and lie against the first surface 32 of the inductor core 3. As such, the electrical contacts, i.e., the first ends 424 and the common contact 41, of the inductor module 2 lie on the same plane of the first surface 32 of the inductor core 3. Such construction is ideal for Surface Mount Technology assembly to facilitate mounting of the inductor module 2 on a circuit board. Further, to reduce the space requirement of the inductor module 2, the first ends 424 of the inductor winding sections 42 extend toward the common contact 41.

Figure 4:
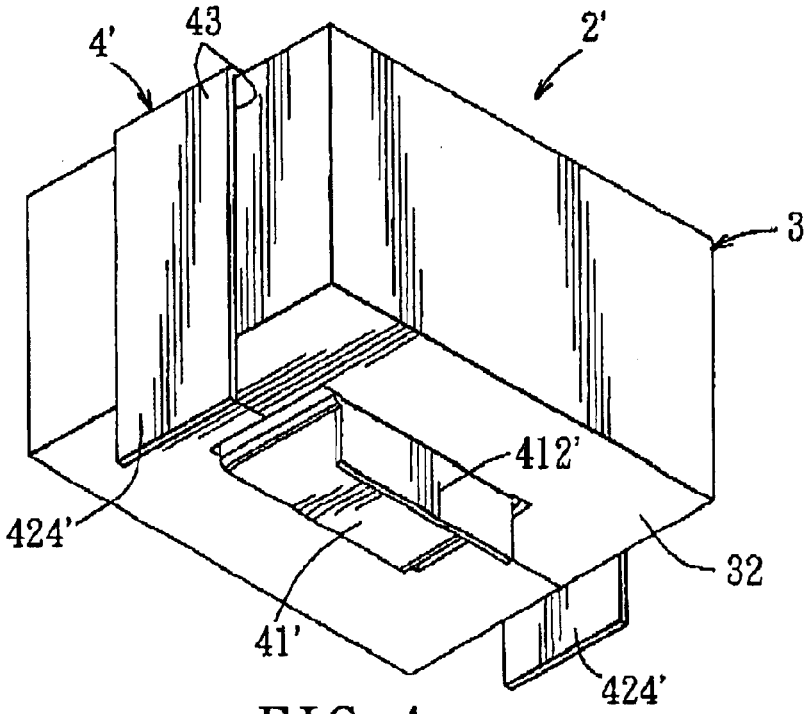
FIG. 4 is a perspective view of the second preferred embodiment of an inductor module according to the present invention.

Referring to FIG. 4, in a modified embodiment of an inductor module 2' according to this invention, the first ends 424' of the inductor winding sections 42' of the inductor winding 4' project transversely relative to the first surface 32 of the inductor core 3, and the common contact 41' is formed with an insert tab 412' that projects transversely relative to the first surface 32 of the common inductor core 3. The first ends 424' and the insert tab 412' permit insert connection of the inductor module 2' with an electronic device.

As mentioned hereinfore, the inductor winding 4, 4' is formed from copper, which is a good heat dissipating material. Preferably, the inductor winding 4, 4' has an outer surface provided with an insulator layer 43 to prevent direct contact between the copper foil and the inductor core 3 that is formed from a magnetic material, thereby avoiding interference therebetween.

It should also be understood that the value of inductance can be adjusted or the size of the inductor core 3 can be reduced by forming the inductor winding sections in a number of turns or by increasing the number of holes to increase the length of inductor winding sections, among many other ways.

Although the inductor module 2, 2' of this invention is exemplified using only a pair of inductor winding sections, it should be apparent to those skilled in the art that the number of inductor winding sections may be increased as required.

It has thus been shown that the inductor module 2, 2' of this invention includes a plurality of inductor winding sections 42 connected to a common contact 41 and wound on a common inductor core 3. The arrangement as such reduces the number of components to facilitate assembly and to result in lower production costs.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An inductor module comprising:

a common inductor core; and an inductor winding including a plurality of inductor winding sections, each of which has a first end and a second end, each of said inductor winding sections being wound on said common inductor core, said inductor winding further including a common contact interconnecting said second ends of said inductor winding sections.

2. The inductor module as claimed in claim 1, wherein said common inductor core includes a first surface, a second surface opposite to said first surface, and a peripheral surface extending between said first and second surfaces, said common inductor core having a plurality of through holes extending from said first surface through said second surface, said common contact being disposed on and lying against said first surface of said common inductor core, each of said inductor winding sections having a first segment extending from said common contact and into a respective one of said through holes, a second segment extending from said first segment and along said second surface of said common inductor core, and a third segment extending from said second segment and along said peripheral surface of said common inductor core.

3. The inductor module as claimed in claim 2, wherein each of said inductor winding sections is generally inverted-U in shape.

4. The inductor module as claimed in claim 2, wherein said third segment of each of said inductor winding sections is formed with said first end that serves as an electrical contact.

5. The inductor module as claimed in claim 4, wherein said first end of each of said inductor winding sections extends along and lies against said first surface of said common inductor core.

6. The inductor module as claimed in claim 4, wherein said first end of each of said inductor winding sections projects transversely relative to said first surface of said common inductor core, and said common contact is formed with an insert tab that projects transversely relative to said first surface of said common inductor core.

7. The inductor module as claimed in claim 2, wherein said common inductor core includes complementary core parts, each of which is formed with a plurality of grooves, each of said through holes being defined by a confronting pair of said grooves in said core parts.

8. The inductor module as claimed in claim 1, wherein said inductor winding is formed integrally from a conductive foil.

9. The inductor module as claimed in claim 8, wherein said conductive foil is made of copper.

10. The inductor module as claimed in claim 8, wherein said common inductor core is made of a magnetic material.

11. The inductor module as claimed in claim 10, wherein said inductor winding has an outer surface provided with an insulator layer.

* * * * *